US005687834A

United States Patent [19]

Simon et al.

[11] Patent Number: 5,687,834

[45] Date of Patent: Nov. 18, 1997

[54] SELECTOR SWITCH HAVING AN EASILY REMOVABLE KNOB

[75] Inventors: Barry S. Simon, Germantown; Ismael Garcia, St. Francis, both of Wis.

[73] Assignee: Allen-Bradley Company, Inc., Milwaukee, Wis.

[21] Appl. No.: 638,064

[22] Filed: Apr. 25, 1996

[51] Int. Cl.[6] ..... H01H 3/08

[52] U.S. Cl. ..... 200/336; 200/564; 200/329

[58] Field of Search ..... 200/329, 61.08, 200/300, 336, 564, 566, 567, 568, 569, 570, 571, 572, 339, 345, 296; 29/622

[56] References Cited

U.S. PATENT DOCUMENTS

| | | | |
|---|---|---|---|
| 2,978,549 | 4/1961 | Krueger | 200/571 |
| 3,367,206 | 2/1968 | Moody | 200/345 |
| 3,511,956 | 5/1970 | Fields | 200/568 |
| 3,794,794 | 2/1974 | Provancher | 200/300 |
| 5,401,925 | 3/1995 | Sambar | 200/296 |
| 5,541,379 | 7/1996 | Kim | 200/565 |

*Primary Examiner*—David J. Walczak
*Attorney, Agent, or Firm*—Joseph N. Ziebert; John M. Miller; John J. Horn

[57] ABSTRACT

A selector switch includes a knob, a bezel and a retaining clip. The retaining clip is mounted on the knob and secures the knob to the bezel. The retaining clip is C-shaped and has a tab centrally disposed on the retaining clip. When the tab is pressed by a tool, the retaining clip contracts and the knob may be detached from the bezel. The tab can be accessed through a slot between the bezel and the knob by a screwdriver. The knob, bezel and retaining clip can be made of plastic.

20 Claims, 2 Drawing Sheets

SELECTOR SWITCH HAVING AN EASILY REMOVABLE KNOB

FIELD OF THE INVENTION

The present invention relates generally to selector switches. More particularly, the present invention relates to a selector switch having a knob secured to a bezel by a retaining clip.

BACKGROUND OF THE INVENTION

Selector switches are found on panels or operator interfaces of a multitude of machinery and equipment. Typically, the selector switches are attached to a switch assembly or switch housing which is secured to a panel. The selector switches can have push button, toggle, rotary, momentary, or other action.

Generally, a selector switch is comprised of a knob mounted on a threaded bezel. The knob is secured onto the bezel by a C-shaped retaining clip. The knob typically includes a selection indicator which points to various options displayed on the panel. The bezel is generally threadably engaged or snapped onto the switch housing disposed in the panel.

Some selector switches include an associated illumination device which provides a representation of the status of the selector switch or of operating conditions associated with the panel. Some selector switches include internal illumination devices such as lamps, bulbs, LED's or other lights which provide illumination for the selector switch. Typically, the illumination device sits in front of the switch housing beneath the bezel. The illumination device is disposed on a latch and power module fixed within the switch housing. For these illuminated selector switches, the switches must be disassembled to replace the illumination device from the front of the panel.

In conventional illuminated selector switches, the bezel must be threadably disengaged from the switch housing to access the illumination device. Alternatively, the illumination device may be accessed from behind the panel. Gaining access to the illumination device by these approaches is disadvantageous because the bezel must be removed to gain access to the device. Removal of the bezel can be a time consuming process.

Thus, there is a need for an advantageous arrangement for holding a knob of a selector switch onto a bezel. The arrangement should allow a selector switch to be quickly and easily disassembled from the front of the panel.

SUMMARY OF THE INVENTION

The present invention relates to a selector switch. The selector switch includes a bezel having an interior cylindrical surface, a knob mounted on the bezel, and a retaining clip. The knob has a lower cylindrical portion. The lower cylindrical portion fits inside the interior cylindrical surface of the bezel when the knob is mounted on the bezel. The retaining clip is engaged to the lower cylindrical portion of the knob. The retaining clip has a tab and is configured to secure the knob onto the bezel. A slot is disposed between the knob and the bezel. The slot is configured to provide access to the tab of the retaining clip.

The present invention further relates to a retaining clip for use in a selector switch including a knob and a bezel. The knob has a selection indicator and a lower cylindrical portion. The bezel has an interior cylindrical surface. The retaining clip includes a C-shaped ring configured to mount on the lower cylindrical portion of the knob and to secure the knob onto the bezel, and a tab mounted at a middle portion of the C-shaped ring.

The present invention still further relates to a method of removing a knob from a bezel in a selector switch. The method includes steps of: inserting a tool into a slot, pressing the tool against a tab, and removing the knob from the bezel. The slot provides access to the tab mounted on the retaining clip. The tab causes the retaining clip to contract to a diameter smaller than a diameter of an interior cylindrical surface of the bezel when the tool presses against the tab.

The present invention advantageously holds the knob of the selector switch onto the bezel. The present invention facilitates the replacement of lamps in illuminated selector switches because the selector switch can be dissembled without removing the bezel from the panel. A tab on the retaining clip allows the knob to be released from the bezel. According to an aspect of the present invention, the bezel has a rim at the top of a interior cylindrical surface and the knob has a groove which receives the retaining clip. The retaining clip is held within the groove and beneath the rim to secure the bezel to the knob.

BRIEF DESCRIPTION OF THE DRAWINGS

The invention hereinafter will be described with reference to the attached drawings, wherein like numerals denote like elements, and.

DETAILED DESCRIPTION OF PREFERRED EXEMPLARY EMBODIMENTS

Figure 1:
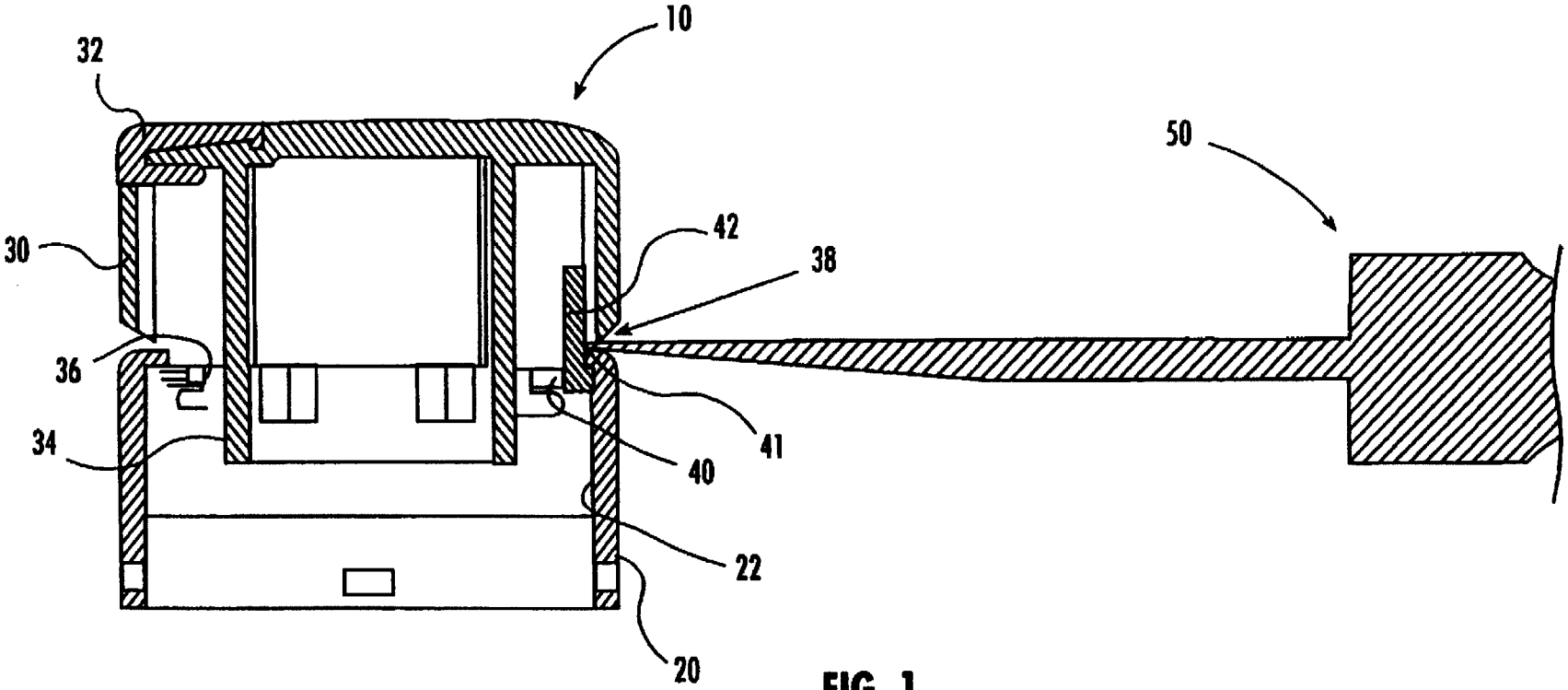
FIG. 1 is a cross-sectional view of an illuminated selector switch in accordance with an exemplary embodiment of the present invention.
Figure 2:
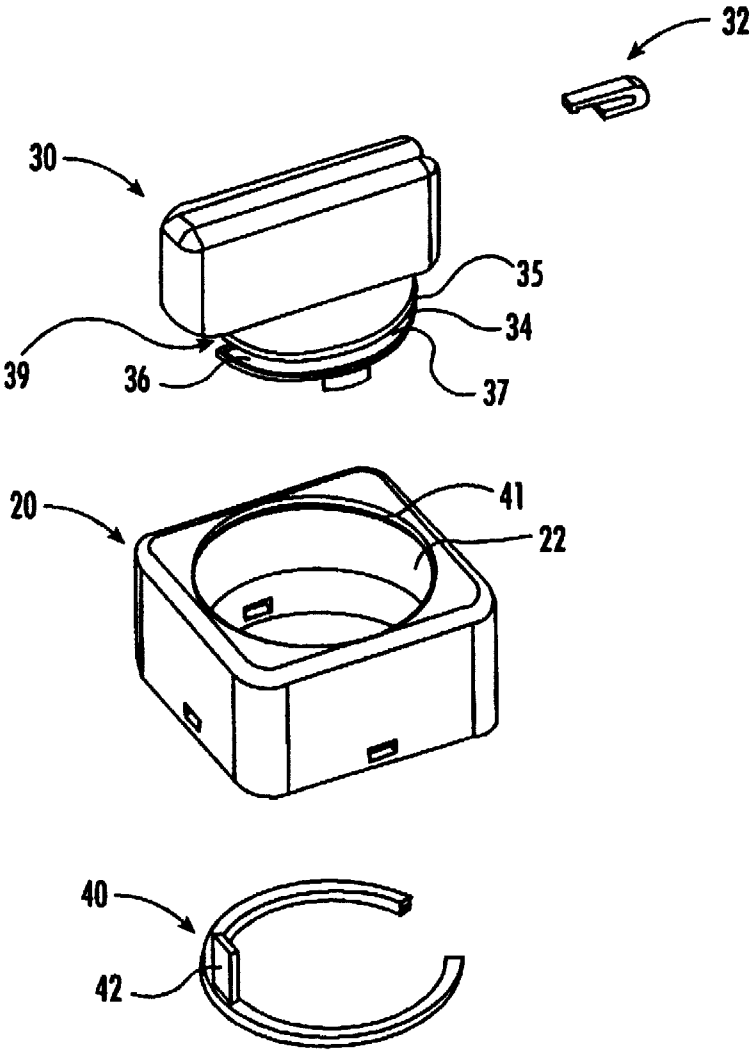
FIG. 2 is an exploded perspective view of the illuminated selector switch illustrated in FIG. 1.

Referring to FIGS. 1 and 2, a selector switch 10 includes a bezel 20, a knob 30, and a retaining clip 40. Generally, selector switch 10 is mounted on a panel (not shown). Selector switch 10 and can be illuminated or non-illuminated.

Bezel 20 has an interior cylindrical surface 22. Interior cylindrical surface 22 is configured to receive a lower cylindrical portion 34 of knob 30, when knob 30 is mounted on bezel 20. Bezel 20 includes a retaining rim 41 at the top of surface 22. Bezel 20 is preferably made of plastic. One such plastic is a 30% glass-filled polyester or Celenex 3316. Bezel 20 and interior surface 22 can be circular or polygonally shaped.

Knob 30 is mounted on bezel 20 such that lower cylindrical portion 34 of knob 30 is disposed within interior cylindrical surface 22 of bezel 20. Knob 30 is preferably made of plastic. For example, knob 30 may be made of GRILLAMID TR55 nylon. Knob 30 and lower cylindrical portion 34 can be circular or polygonally shaped. Knob 30 can also be a toggle lever or other user actionable device.

Knob 30 includes a pointer or selection indicator 32 and a groove 36. Indicator 32 can be a colorful piece with any of a variety of markings. Indicator 32 may be removed from knob 30 and replaced with another indicator of a different color or marking. Groove 36 is disposed in and around lower cylindrical portion 34. Groove 36 is configured to receive retaining clip 40.

Knob 30 is secured onto bezel 20 by retaining clip 40. Retaining clip 40 is a flexible C-shaped ring and includes a tab 42. Retaining clip 40 is mounted in groove 36 and around lower cylindrical portion 34 of knob 30. Tab 42 is located at an opposite end from indicator 32 when retaining clip 40 is mounted on knob 30. Knob 30 and retaining clip 40 are inserted into bezel 20 by radially compressing retaining clip 40 to a diameter smaller than a diameter of rim 41. Once lower cylindrical portion 34 of knob 30 (with retaining clip 40 mounted in a groove 36) is placed in bezel 20 retaining clip 40 expands to a diameter larger than a diameter of rim 41, securing knob 30 onto bezel 20. More particularly, retaining clip 40 is held between an upper rim 35 and a lower rim 37 of knob 30 and prevents knob 30 from being moved past rim 41 of bezel 20.

Knob 30 and bezel 20 form a slot 38 when knob 30 is secured onto bezel 20. Slot 38 may be a clearance or an aperture and is disposed between knob 30 and bezel 20 and provides access to tab 42 of retaining clip 40. In addition , slot 38 may also be an aperture 39 in knob 30, as shown in FIG. 2. Tab 42 allows knob 30 to be detached from bezel 20. To remove knob 30 from bezel 20, a tool 50, such as a screwdriver, is inserted into slot 38. Tool 50 is then pressed against tab 42. When tab 42 is depressed by tool 50, retaining clip 40 contracts to a diameter smaller than the diameter of rim 41 on interior cylindrical surface 22, and knob 30 along with retaining clip 40 may be detached from bezel 20.

The advantageous orientation of selector switch 10 places slot 38 at an opposite end of indicator 32 so an operator can more easily find slot 38 and hence tab 42. The easy removal of knob 30 allows an operator to replace lamps within the housing (not shown) to which bezel 30 is attached. Be removing knob 30 from the top of the panel, the operator does not have to completely remove bezel 30 or access switch 10 from behind the panel.

Retaining clip 40 is preferably made of a flexible plastic. For example, retaining clip 40 may be made of acetal as manufactured by HOECHST-CELANESE, CELCON M90-04. One unexpected advantage of the present invention is a more uniform retaining clip. With prior C-shaped retaining clips, plastic is injected at one end of a C-shaped clip mold. Injecting plastic from one end results in an uneven amount of plastic throughout the retaining clip, with more plastic at the input end and less at the other. The tab on the retaining clip of the present invention provides a natural input of plastic for injection molding. Because the tab is located at the middle of the C-shaped retaining clip, both ends will receive the same amount of plastic.

If selector switch 10 does not utilize a lamp or other illumination device, knob 30 can be permanently attached to bezel 20 by utilizing clip 40 without tab 42. Economies of scale can be achieved by utilizing essentially the same components for illuminated and non-illuminated selector switches. Clip to can be configured for permanent attachment by simply removing tab 42.

It is understood that the above description is of a preferred exemplary embodiment of the present invention. The apparatus and method of the invention are not limited to the specific form shown. For example, although plastic materials are suggested and a rotary know is shown, other shapes and materials can be utilizes. Various modifications may be made to the details of the disclosure without departing from the spirit of the invention which is defined in the appended claims.

What is claimed is:

1. A selector switch comprising:

a bezel having an interior cylindrical surface;

a knob mounted on the bezel, the knob having a selection indicator and a lower cylindrical portion, wherein the lower cylindrical portion fits inside the interior cylindrical surface of the bezel when the knob is mounted on the bezel; and a retaining clip mounted around the lower cylindrical portion of the knob, the retaining clip having a tab and being configured to secure the knob onto the bezel, wherein a slot is disposed between the knob and the bezel, the slot being configured to provide access to the tab of the retaining clip.

2. The selector switch of claim 1, wherein the retaining clip is a C-shaped ring.

3. The selector switch of claim 2, wherein a circumference of the C-shaped ring is decreased when the tab is pressed.

4. The selector switch of claim 2, wherein the tab is located at a middle portion of the retaining clip.

5. The selector switch of claim 4, wherein the retaining clip is mounted on the knob such the tab is at an opposite end from the selection indicator.

6. The selector switch of claim 5, wherein the slot is a clearance between the knob and the bezel.

7. The selector switch of claim 5, wherein the slot is an aperture between the knob and the bezel.

8. The selector switch of claim 5, wherein the slot is an aperture in the knob.

9. A selector switch comprising:

a bezel having an interior cylindrical surface;

a knob mounted on the bezel, the knob having a selection indicator and a lower cylindrical portion, wherein the lower cylindrical portion fits inside the interior cylindrical surface of the bezel when the knob is mounted on the bezel; and a retaining clip including a C-shaped ring having two ends mounted around the lower cylindrical portion of the knob to secure the knob onto the bezel, and a tab mounted at a middle portion of the C-shaped ring between the two ends, wherein a slot is disposed between the knob and the bezel, the slot being configured to provide access to the tab of the retaining clip.

10. The selector switch of claim 9, wherein the retaining clip is mounted on the knob such that the tab is at an opposite end from the selection indicator.

11. The selector switch of claim 9, wherein the C-shaped ring is plastic.

12. The selector switch of claim 9, wherein a circumference of the C-shaped ring is decreased when the tab is pressed.

13. In a selector switch having a knob, a bezel and a retaining clip, a method of removing the knob from the bezel, the method comprising the steps of:

inserting a tool into a slot, the slot providing access to a tab mounted on the retaining clip;

pressing the tool against the tab, the tab causing the retaining clip to contract to a diameter smaller than a diameter of a rim of the bezel; and removing knob from the bezel.

14. The method of claim 13, wherein the retaining clip is a C-shaped ring.

15. The method of claim 14, wherein the tab is located at the middle of the retaining clip.

16. The method of claim 15, wherein the tab is located at an opposite end from an indicator on the knob when the retaining clip is mounted on the knob.

17. The method of claim 16, wherein the slot is a clearance between the knob and the bezel.

18. The method of claim 16, wherein the slot is an aperture between the knob and the bezel.

19. The method of claim 16, wherein the slot is an aperture in the knob.

20. The selector switch of claim 1, wherein the retaining clip is plastic.

* * * * *